US010384902B2

(12) United States Patent
Shiina

(10) Patent No.: US 10,384,902 B2
(45) Date of Patent: Aug. 20, 2019

(54) SHEET CONVEYANCE APPARATUS AND IMAGE FORMING APPARATUS

(71) Applicant: CANON KABUSHIKI KAISHA, Tokyo (JP)

(72) Inventor: Sachiyori Shiina, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/029,969

(22) Filed: Jul. 9, 2018

(65) Prior Publication Data

US 2019/0033769 A1 Jan. 31, 2019

(30) Foreign Application Priority Data

Jul. 26, 2017 (JP) ..... 2017-144926

(51) Int. Cl.

| | |
|---|---|
| ***B65H 29/70*** | (2006.01) |
| ***B65H 43/06*** | (2006.01) |
| ***B65H 29/60*** | (2006.01) |
| ***B65H 29/14*** | (2006.01) |
| ***B65H 85/00*** | (2006.01) |
| ***B65H 29/12*** | (2006.01) |
| ***B65H 29/52*** | (2006.01) |
| ***G03G 15/23*** | (2006.01) |

(52) U.S. Cl.

CPC ..... *B65H 29/70* (2013.01); *B65H 29/125* (2013.01); *B65H 29/14* (2013.01); *B65H 29/52* (2013.01); *B65H 29/60* (2013.01); *B65H 43/06* (2013.01); *B65H 85/00* (2013.01); *G03G 15/234* (2013.01)

(58) Field of Classification Search

CPC ..... B65H 29/125; B65H 29/14; B65H 29/52; B65H 29/70; B65H 85/00

USPC ..... 271/188, 65, 184, 301, 291

See application file for complete search history.

(56) References Cited

U.S. PATENT DOCUMENTS 5,312,108 A * 5/1994 Hayashi ..... B65H 29/70 271/188

5,648,807 A * 7/1997 Saito ..... B41J 2/1752 271/188

(Continued)

FOREIGN PATENT DOCUMENTS

| | | |
|---|---|---|
| JP | 2001-240286 A | 9/2001 |
| JP | 2004-345841 A | 12/2004 |
| JP | 2007-269456 A | 10/2007 |

*Primary Examiner* — David H Bollinger

(74) *Attorney, Agent, or Firm* — Venable LLP

(57) ABSTRACT

A sheet conveyance apparatus includes a reverse conveyance portion and a second conveyance direction, a supporting portion configured to support a lower surface of the sheet conveyed by the reverse conveyance portion, and an opposing portion provided along and above the supporting portion. Either one of the supporting portion and the opposing portion includes a first projected portion. The other of the supporting portion and the opposing portion includes a second projected portion and a third projected portion. The first projected portion is arranged between the second projected portion and the third projected portion in a width direction intersecting with the first conveyance direction. At least a part of the first projected portion is arranged to overlap with the second projected portion and the third projected portion in a sheet thickness direction.

13 Claims, 9 Drawing Sheets

(56) References Cited

U.S. PATENT DOCUMENTS

| | | | | |
|---|---|---|---|---|
| 7,802,787 | B2 * | 9/2010 | Miwa | B65H 29/14 271/184 |
| 2001/0015144 | A1 * | 8/2001 | Tsurumaki | B65H 29/70 101/232 |
| 2015/0091235 | A1 * | 4/2015 | Noso | G03G 15/6573 271/3.2 |
| 2015/0353314 | A1 * | 12/2015 | Wada | B65H 29/125 271/176 |
| 2017/0305702 | A1 * | 10/2017 | Noso | B65H 31/02 |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus configured to convey sheets, and an image forming apparatus equipped with the same.

Description of the Related Art

In general, image forming apparatuses such as printers form an image on a sheet fed from a cassette using an image forming unit and discharges the sheet on a sheet discharge tray. Further, when forming images on both sides of the sheet, the sheet on which an image has been formed on a front surface is subjected to switch back by which the front and rear surfaces are reversed, and the sheet is conveyed again to the image forming unit to have an image formed on the rear surface thereof.

Hitherto, a printer equipped with a reverse conveyance unit for reversing a conveyance direction of a sheet to an opposite direction disposed on a rear side of a printer body has been proposed (Japanese Patent Application Laid-Open Publication No. 2001-240286). The reverse conveyance unit includes a conveyance roller pair that can be rotated in normal and reverse directions, and in a state where the trailing edge of the sheet is nipped by the conveyance roller pair and a large portion of the sheet is exposed to the exterior of the apparatus, the conveyance roller performs switch back of the sheet. Further, the reverse conveyance unit includes a wave-shape forming unit configured to curve the sheet subjected to switch-back by the conveyance roller pair in a waveform in the width direction of the sheet. By imparting stiffness to the sheet by the wave-shape forming unit, a free end portion of the sheet will not hang down during switch back, and the sheet can be subjected to switch-back in a stable manner.

As an example of the wave-shape forming unit, a configuration is disclosed where a collar protruding to a nip line of the conveyance roller pair is provided, a nip of the conveyance roller pair is formed into a curved shape, or a guide rib configured to curve the sheet is arranged near the conveyance roller pair.

However, the reverse conveyance unit according to Japanese Patent Application Laid-Open Publication No. 2001-240286 is configured to prevent the sheet from hanging down only by the stiffness of the sheet imparted by the wave-shape forming unit, and it was insufficient especially in a state where the sheet is discharged in a direction along a horizontal direction.

SUMMARY OF THE INVENTION

According to one aspect of the present invention, a sheet conveyance apparatus includes a reverse conveyance portion configured to convey a sheet in a first conveyance direction and a second conveyance direction that is opposite to the first conveyance direction, a supporting portion arranged downstream of the reverse conveyance portion in the first conveyance direction and configured to support a lower surface of the sheet conveyed by the reverse conveyance portion, and an opposing portion provided along and above the supporting portion and opposing to the supporting portion. Either one of the supporting portion and the opposing portion comprises a first projected portion that protrudes toward the other of the supporting portion and the opposing portion. The other of the supporting portion and the opposing portion comprises a second projected portion and a third projected portion that protrude toward the one of the supporting portion and the opposing portion. The first projected portion is arranged between the second projected portion and the third projected portion in a width direction intersecting with the first conveyance direction. At least a part of the first projected portion is arranged to overlap with the second projected portion and the third projected portion in a sheet thickness direction intersecting with the first conveyance direction and the width direction.

Further features of the present invention will become apparent from the following description of exemplary embodiments with reference to the attached drawings.

DESCRIPTION OF THE EMBODIMENTS

First Embodiment

Overall Configuration

Figure 1:
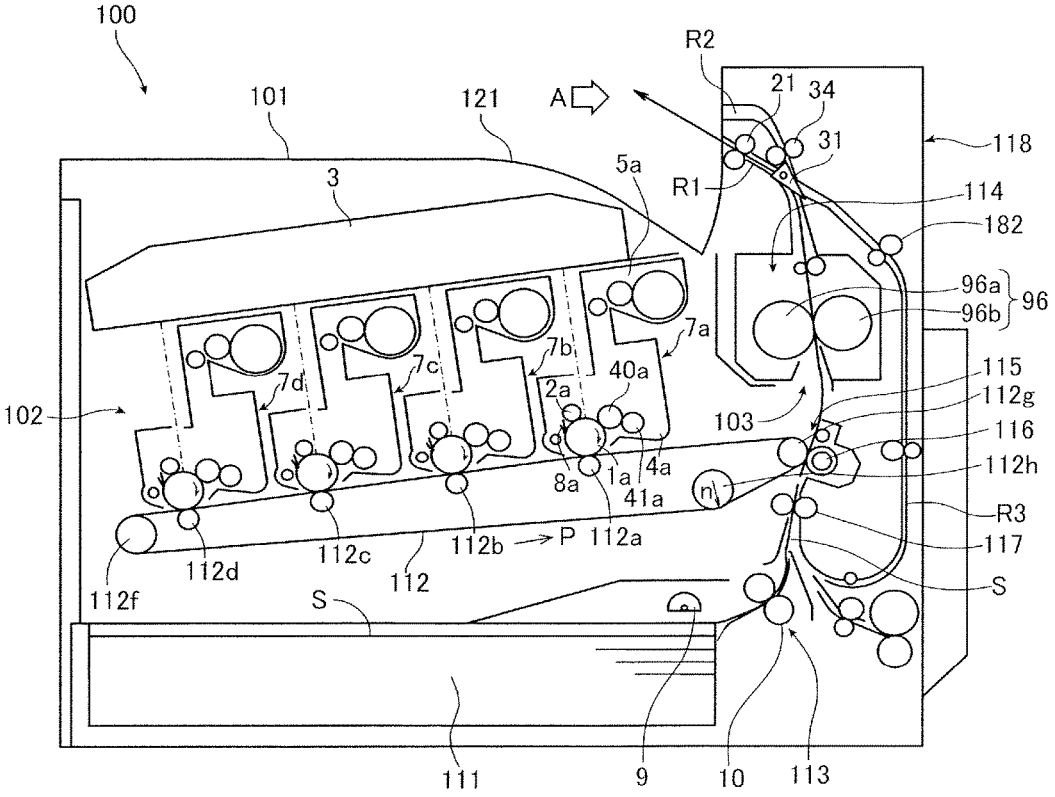
FIG. 1 is an entire schematic drawing illustrating a printer according to a first embodiment.

Now, a first embodiment of the present embodiment will be described. A printer 100 serving as an image forming apparatus according to the first embodiment is a laser beam printer adopting an electrophotographic system. As illustrated in FIG. 1, the printer 100 includes an image forming unit 102 configured to form an image on a sheet S, a sheet feeding apparatus 113, a fixing unit 96, and a sheet discharge apparatus 118 serving as a sheet conveyance apparatus. The image forming unit 102 serving as the image forming unit includes four process cartridges 7*a*, 7*b*, 7*c* and 7*d* respectively forming toner images of four colors, which are yellow (Y), magenta (M), cyan (C) and black (K), and a scanner unit 3. These four process cartridges 7*a*, 7*b*, 7*c* and 7*d* are arranged approximately horizontally.

The four process cartridges 7*a*, 7*b*, 7*c* and 7*d* adopt the same configuration except for the difference in the colors of the image being formed. Therefore, only the configuration and the image forming process of the process cartridge 7*a* will be described, and the descriptions of process cartridges 7*b*, 7*c* and 7*d* will be omitted.

The process cartridge 7*a* comprises a photosensitive drum 1*a*, a charge roller 2*a*, a developing unit 4*a*, a toner unit 5*a* and a drum cleaning blade 8*a*. The photosensitive drum 1*a* is formed by coating an organic photoconductive layer on an outer circumference of an aluminum cylinder, and the photosensitive drum is rotated by a drive motor not shown. The developing unit 4*a* includes a developing roller 40*a* and a developer coating roller 41*a*, and the developing unit is connected to the toner unit 5*a*. An intermediate transfer belt 112 is arranged below the process cartridges 7*a*, 7*b*, 7*c* and 7*d*. The intermediate transfer belt 112 is stretched among a drive roller 112*f*, a secondary transfer counter roller 112*g* and a tension roller 112*h*, and tension is applied to the intermediate transfer belt 112 in an arrow n direction by the tension roller 112*h*.

Primary transfer rollers 112*a*, 112*b*, 112*c* and 112*d* are arranged on an inner side of the intermediate transfer belt 112. A secondary transfer roller 116 is arranged on an opposite side from the secondary transfer counter roller 112*g* intervening the intermediate transfer belt 112, and the intermediate transfer belt 112 together with the secondary transfer roller 116 forms a secondary transfer nip 115 serving as a transfer nip. The fixing unit 96 includes a fixing roller 96*a* heated by a heater and a pressure roller 96*b* in pressure contact with the fixing roller 96*a*. The sheet feeding apparatus 113 is arranged below the printer 100 and stores sheets S.

The sheet discharge apparatus 118 includes a guide member 31 that switches a conveyance path of sheet S between a sheet discharge path R1 and a reverse conveyance path R2, a sheet discharge roller pair 21 serving as a sheet discharge portion provided on the sheet discharge path R1, and a reverse conveyance roller pair 34 provided on the reverse conveyance path R2.

Next, an image forming operation of the printer 100 configured as above will be described. If image signals are entered to the scanner unit 3 from a personal computer and the like not shown, laser beams corresponding to the image signals are irradiated from the scanner unit 3 to the photosensitive drum 1*a* of the process cartridge 7*a*.

In this state, the surface of the photosensitive drum 1*a* is uniformly charged in advance to predetermined polarity and potential by the charge roller 2*a*, and by irradiating laser beams from the scanner unit 3, an electrostatic latent image is formed on the surface. The electrostatic latent image formed on the photosensitive drum 1*a* is developed by the developing unit 4*a*, and a yellow (Y) toner image is formed on the photosensitive drum 1*a*.

Similarly, laser beams are irradiated from the scanner unit 3 to the respective photosensitive drums of the process cartridges 7*b*, 7*c* and 7*d*, by which magenta (M), cyan (C) and black (K) toner images are formed on the respective photosensitive drums. The toner images of respective colors formed on the respective photosensitive drums are transferred by the primary transfer rollers 112*a*, 112*b*, 112*c* and 112*d* to the intermediate transfer belt 112, and conveyed by the intermediate transfer belt 112 rotated by the drive roller 112*f* to the secondary transfer roller 116. The image forming process of each color is performed at a timing to be superposed on the toner image primarily transferred at an upstream position on the intermediate transfer belt 112. After the toner images are transferred, the toner remaining on the surface of the photosensitive drum 1*a* is removed by the drum cleaning blade 8*a*.

In parallel with the image forming process, the sheet S stored in a cassette 111 of the sheet feeding apparatus 113 is sent out by a pickup roller 9 and separated one by one by a separation roller pair 10 forming a separation nip. One of the rollers of the separation roller pair 10 is connected to a torque limiter not shown, and when only one sheet is fed by the pickup roller 9, the torque limiter is idly rotated together with the pickup roller 9. One of the rollers of the separation roller pair 10 stops rotating if two or more sheets are fed by the pickup roller 9 and prevents the second and subsequent sheets from being conveyed. A drive toward the opposite direction as the sheet conveyance direction can be entered to one of the rollers of the separation roller pair 10, or a separating pad can be provided instead of one of the rollers of the separation roller pair 10.

The sheet S conveyed by the pickup roller 9 and the separation roller pair 10 is subjected to skew feed correction by a registration roller pair 117. Further, the registration roller pair 117 conveys the sheet S toward the secondary transfer nip 115 at a matched timing with the image conveyed by the intermediate transfer belt 112. A full-color toner image on the intermediate transfer belt 112 is transferred at the secondary transfer nip 115 to the sheet S by a secondary transfer bias applied to the secondary transfer roller 116. Predetermined heat and pressure is applied by the fixing roller 96*a* and the pressure roller 96*b* of the fixing unit 96 to the sheet S to which the toner image has been transferred, and the toner is melted and fixed. The sheet S passed through the fixing unit 96 is guided by the guide member 31 to the sheet discharge path R1 and discharged onto a sheet discharge tray 121 serving as a sheet stacking portion by a sheet discharge roller pair 21 of the sheet discharge apparatus 118.

If images are to be formed on both sides of the sheet S, the sheet S on which image has been formed on the first side is guided by the guide member 31 to the reverse conveyance path R2, and after the trailing edge of the sheet S passes the front end of the guide member 31, the sheet is subjected to switch-back by the reverse conveyance roller pair 34. That is, the leading edge of the sheet S becomes the trailing edge by the switch back of the sheet S. The sheet S subjected to switch-back by the reverse conveyance roller pair 34 is guided by the guide member 31 to a duplex conveyance path R3 and conveyed by a duplex conveyance roller pair 182 toward the secondary transfer nip 115 again. An image is formed on a second side of the sheet S at the secondary transfer nip 115 and discharged to the sheet discharge tray 121 by the sheet discharge roller pair 21.

Sheet Discharge Apparatus

Figure 2:
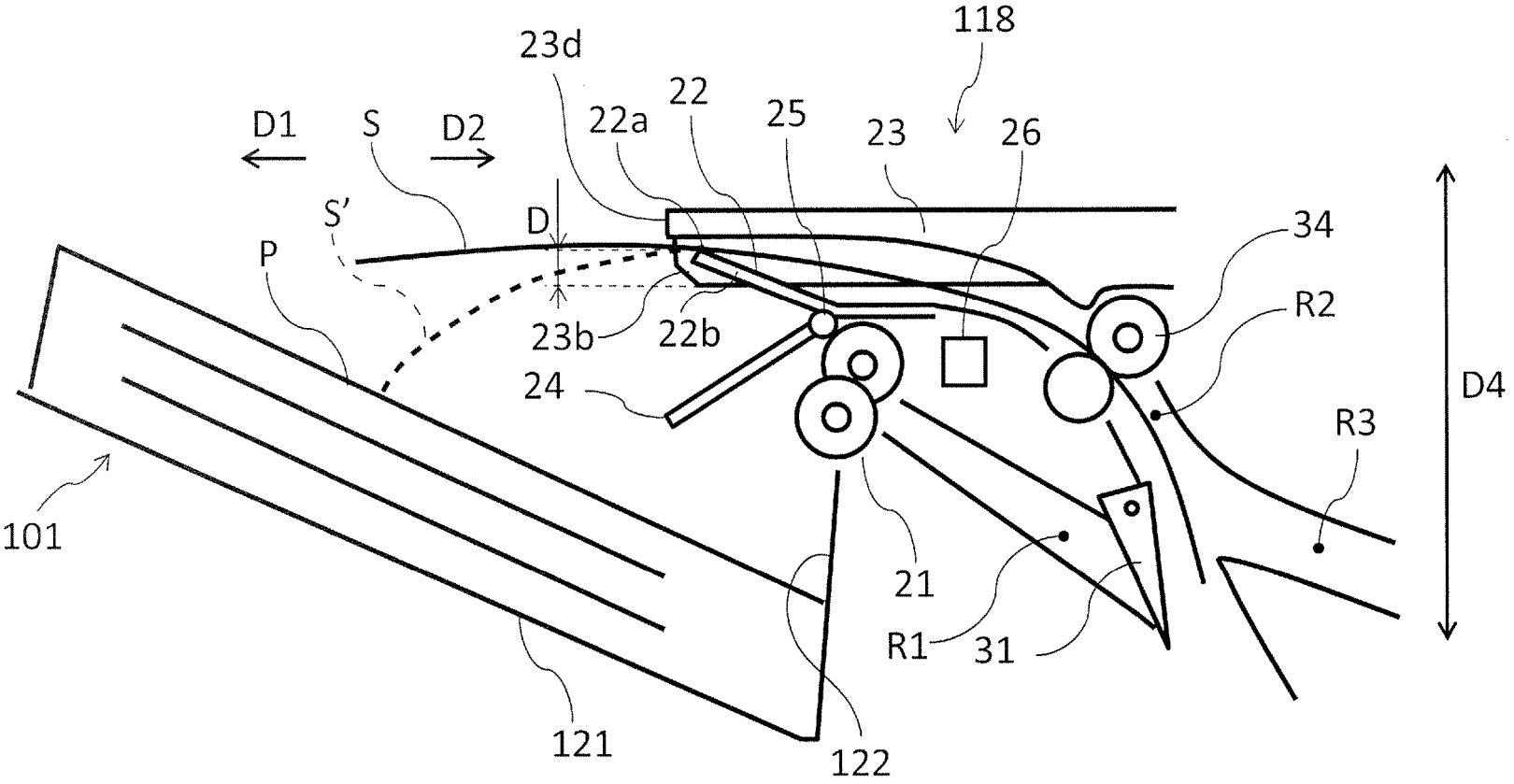
FIG. 2 is a cross-sectional view illustrating a sheet discharge apparatus.

Next, the sheet discharge apparatus 118 will be described in detail. FIG. 2 is a B-B cross-sectional view of FIG. 3 described later, which illustrates the sheet discharge apparatus 118. As illustrated in FIG. 2, the sheet discharge apparatus 118 includes a sheet discharge tray 121 constituting an exterior surface of an apparatus body 101 of the printer 100, and a trailing edge regulating surface 122 configured to regulate a trailing edge position of sheet P supported on the sheet discharge tray 121. The sheet discharge tray 121 has an inclined surface that is inclined upward toward the downstream direction in a sheet discharge direction D1, and the sheet discharged onto the sheet discharge tray 121 by the sheet discharge roller pair 21 is configured to slide on the sheet discharge tray 121 until the trailing edge abuts against the trailing edge regulating surface 122.

A reverse tray 22 that protrudes more downstream than the trailing edge regulating surface 122 in the sheet discharge direction D1 is provided above the sheet discharge roller pair 21, and a top cover 23 is provided above the reverse tray 22. The reverse tray 22 and the top cover 23 are fixed members that are fixed to the apparatus body 101. The top cover 23 is provided along and above the reverse tray 22, and covering an upper part of the reverse tray 22. The reverse conveyance roller pair 34 serving as the reverse conveyance portion has a nip portion configured to nip and convey the sheet, and the reverse conveyance roller pair 34 is configured to convey the sheet in the sheet discharge direction D1 serving as a first conveyance direction and a reverse direction D2 serving as a second conveyance direction that is opposite to the sheet discharge direction D1.

A pivot shaft 25 of a full load detection flag 24 is provided between the reverse tray 22 and the sheet discharge roller pair 21, and a full load detection sensor 26 detects full load of the sheets P on the sheet discharge tray 121 according to a pivot angle of the full load detection flag 24. That is, if a sheet P is stacked on the sheet discharge tray 121, an uppermost sheet of the sheets P supported on the tray presses the full load detection flag 24, and the full load detection flag 24 pivots around the pivot shaft 25. If the full load detection flag 24 pivots for a predetermined angle or greater, the full load detection sensor 26 serving as a detection portion outputs a signal indicating that the sheet discharge tray 121 is in a full-load state.

Figure 3:
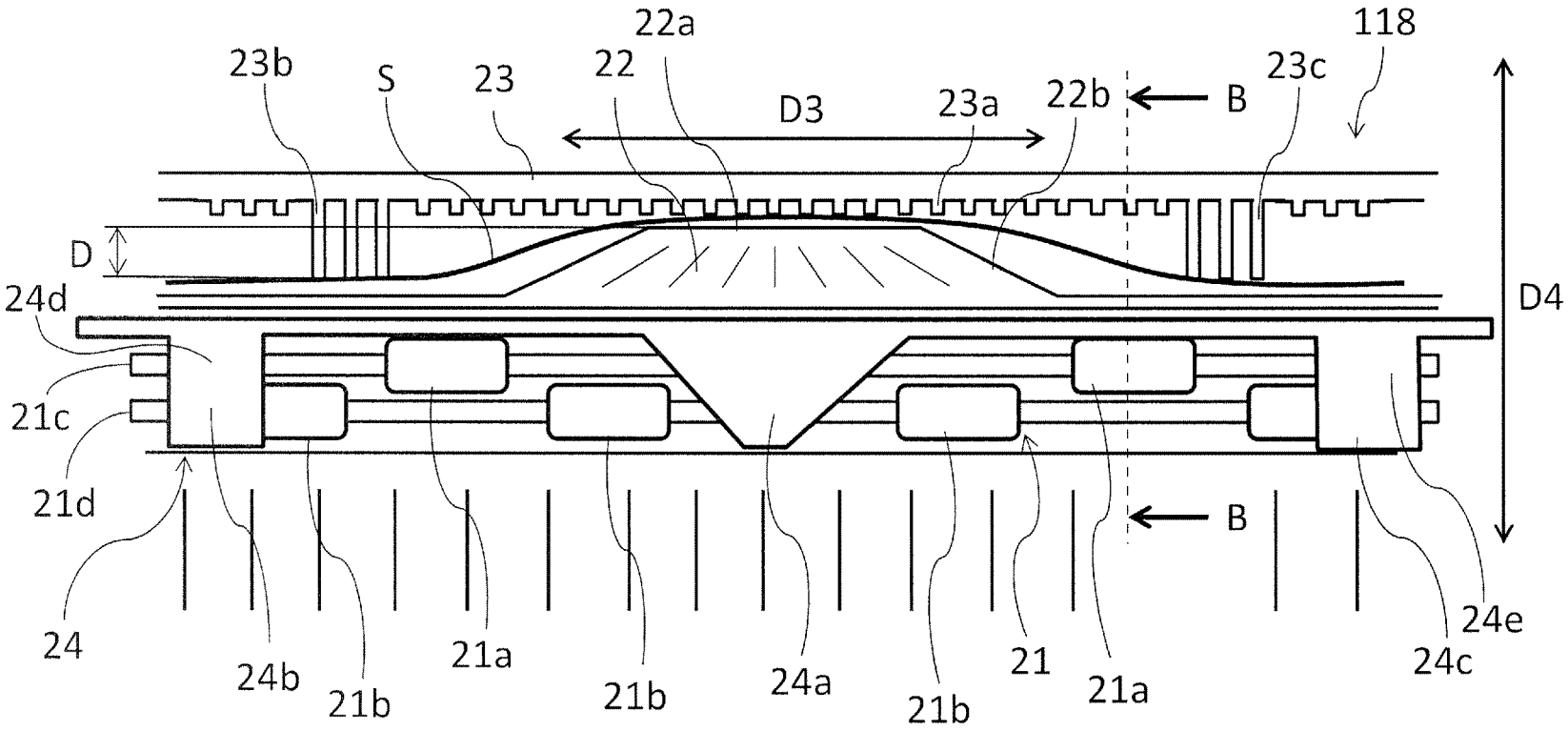
FIG. 3 is a view illustrating the sheet discharge apparatus viewed from the direction of arrow A of FIG. 1.

FIG. 3 is a view illustrating the sheet discharge apparatus 118 from arrow A direction of FIG. 1. As illustrated in FIG. 3, the sheet discharge roller pair 21 includes a plurality of (two, according to the present embodiment) sheet discharge drive rollers 21*a* fixed to a drive shaft 21*c*, and a plurality of (four, according to the present embodiment) sheet discharge driven rollers 21*b* fixed to a driven shaft 21*d*. The sheet discharge drive rollers 21*a* and the sheet discharge driven rollers 21*b* are arranged alternately and slightly overlapped with each other in a sheet thickness direction D4. Therefore, the sheet is deformed in a waveform shape in the width direction and stiffened when passing the sheet discharge roller pair 21, and the sheet is discharged to the sheet discharge tray 121. Thereby, the stackability of the sheet supported on the sheet discharge tray 121 can be improved.

Configuration of Reverse Tray and Top Cover

The reverse tray 22 serving as a supporting portion is formed to incline upward toward a tip portion 22*a* thereof, as illustrated in FIGS. 2 and 3, and a center portion 22*b* including the tip portion 22*a* is protruded upward toward the top cover 23. The center portion 22*b* of the reverse tray 22 supports the lower surface of the sheet while sliding on the surface of the sheet conveyed by the reverse conveyance roller pair 34.

The top cover 23 is formed along the sheet discharge direction D1 and includes a plurality of first conveyance ribs 23*a* extending downward toward the reverse tray 22, and second and third conveyance ribs 23*b* and 23*c* that extend further downward than the first conveyance ribs 23*a*. The second conveyance ribs 23*b* serving as the second projected portion are arranged at one side of the center portion 22*b* of the reverse tray 22 in a width direction D3 orthogonal to the sheet discharge direction D1. It is noted that the width direction D3 may not be precisely orthogonal to the sheet discharge direction D1, but may intersect with the sheet discharge direction D1. The third conveyance ribs 23*c* serving as the third projected portion are arranged on the other side of the center portion 22*b* of the reverse tray 22 in the width direction D3. That is, the center portion 22*b* serving as the first projected portion is arranged between the second conveyance ribs 23*b* and the third conveyance ribs 23*c* in the width direction D3.

In the present embodiment, the second conveyance ribs 23*b* and the third conveyance ribs 23*c* are composed of three ribs, but it can be composed of any number of ribs. The number of ribs of the second conveyance ribs 23*b* and the third conveyance ribs 23*c* are determined arbitrarily in view of reducing the conveyance resistance by narrowing the area of slide movement on the sheet, and the strength of the ribs.

At least a part of the center portion 22*b* of the reverse tray 22 viewed from the width direction is arranged to overlap with the second conveyance ribs 23*b* and the third conveyance ribs 23*c*, as illustrated in FIG. 2. That is, the center portion 22*b* of the reverse tray 22 is arranged such that at least a part thereof is overlapped with the second and third conveyance ribs 23*b* and 23*c* in the sheet discharge direction D1 and the sheet thickness direction D4. Specifically, the center portion 22*b* is overlapped with the second conveyance ribs 23*b* and the third conveyance ribs 23*c* for distance D in the sheet thickness direction D4. The sheet thickness direction D4 is a direction orthogonal to the sheet discharge direction D1 and the sheet width direction D3. It is noted that the sheet thickness direction D4 may not be precisely orthogonal to the sheet discharge direction D1 and the sheet width direction D3, but may intersect with the sheet discharge direction D1 and the sheet width direction D3.

Figure 4:
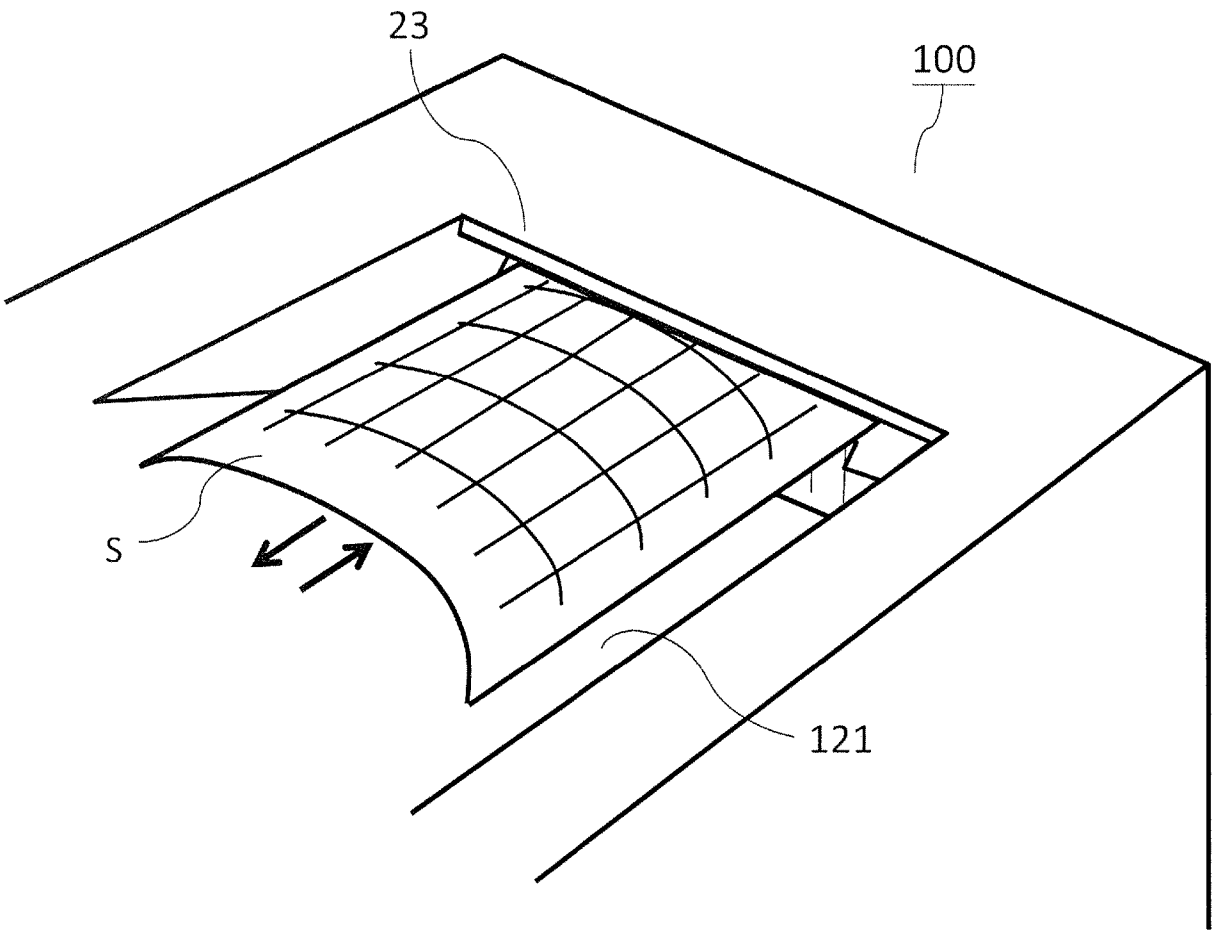
FIG. 4 is a perspective view illustrating a sheet having stiffness imparted by the sheet discharge apparatus.

The sheet conveyed by the reverse conveyance roller pair 34 is deformed by the center portion 22*b* of the reverse tray 22 and the second and third conveyance ribs 23*b* and 23*c* of the top cover 23 configured as above so that the center area is convexed upward as illustrated in FIG. 4, and stiffness of the sheet is imparted thereby. Further, since the lower surface of the sheet S is supported by the center portion 22*b* of the reverse tray 22, the sagging of the sheet S can be prevented even if the leading edge of the sheet S which is a free end is suspended in the air. Specifically, if the discharge direction of the sheet is close to a horizontal direction, the leading edge of the sheet may easily sag, but according to the present embodiment, the reverse tray 22 securely supports the sheet from the reverse conveyance roller pair 34 to the reverse tray 22. Therefore, the distance from the tip end of the reverse tray 22 where the sheet is suspended in air to the free end of the sheet is shortened, and the sheet can be prevented from sagging.

Now, a sheet S' to which stiffness has not been imparted by the center portion 22*b*, the second conveyance ribs 23*b* and the third conveyance ribs 23*c* is illustrated by the broken line of FIG. 2. The leading edge of the sheet S' on the downstream side of the reverse tray 22 in the sheet discharge direction D1 may sag down and strongly collide against the sheet P on the sheet discharge tray 121, deteriorating the alignment performance of the sheet P. Meanwhile, the sheet S to which stiffness has been imparted, illustrated by the solid line of FIG. 2, is suppressed from sagging at the leading edge on the downstream side of the reverse tray 22 in the sheet discharge direction D1. Therefore, the position of abutment of the sheet S to the sheet P on the sheet discharge tray 121 is positioned downstream in the sheet discharge direction D1 compared to sheet S', so that the abutment angle with the sheet P on the sheet discharge tray 121 becomes smaller and the deterioration of alignment performance of the sheet P can be prevented.

Further, as illustrated in FIG. 2, the reverse conveyance roller pair 34 is arranged upstream at a distance from the reverse tray 22 in the sheet discharge direction D1. Therefore, if stiffness is imparted to the sheet by the reverse tray 22 and the top cover 23, the influence of the stiffness imparted to the sheet is not strong at the position of the reverse conveyance roller pair 34. That is, the sheet S is curled in a manner convexed to the upper direction near the reverse tray 22, but at the position of the reverse conveyance roller pair 34, the sheet can be conveyed with the curl approximately eliminated. Therefore, the conveyance resistance at the reverse conveyance roller pair 34 is reduced and the skewing of the sheet S may be reduced thereby. Further, even if the reverse conveyance roller pair 34 and the reverse tray 22 are connected by a curved conveyance path, the conveyance resistance of the sheet will not be high during reverse conveyance, and the skewing of the sheet S can be reduced.

Further, since the position of switch-back by the reverse conveyance roller pair 34 is arranged further inward of the printer 100, only a small amount of the sheet S is exposed to the exterior while being reversed, so the sagging of the sheet is reduced. Even further, since the reverse conveyance roller pair 34 is arranged at a position distant from an exterior cover of the apparatus body 101, the deflection of the exterior cover and the like will not easily influence the reverse conveyance roller pair 34, and the conveyance failure of the sheet is suppressed.

Configuration of Full Load Detection Flag

Next, the configuration of the full load detection flag 24 will be described. The full load detection flag 24 includes, as illustrated in FIG. 3, a projected center portion 24*a* positioned at a center portion in the width direction, and projected side portions 24*b* and 24*c* positioned on both ends in the width direction. The projected center portion 24*a* and the projected side portions 24*b* and 24*c* are protruded toward the sheet discharge direction D1 compared to the other portions of the full load detection flag 24. The projected center portion 24*a* is formed in an approximately triangular shape, and the projected side portions 24*b* and 24*c* serving as fourth and fifth projected portions are formed in a rectangular shape. In a state where the projected center portion 24*a* of the full load detection flag 24 is pressed by the sheet supported on the sheet discharge tray 121, the full load detection flag 24 pivots upward. Further, the projected side portions 24*b* and 24*c* push the end portions in the width direction of the sheet supported on the sheet discharge tray 121 from above. Thereby, gutter-shaped curls formed at the end portions in the width direction of the sheet by temperature difference in the fixing unit 96 can be corrected.

Figure 5:
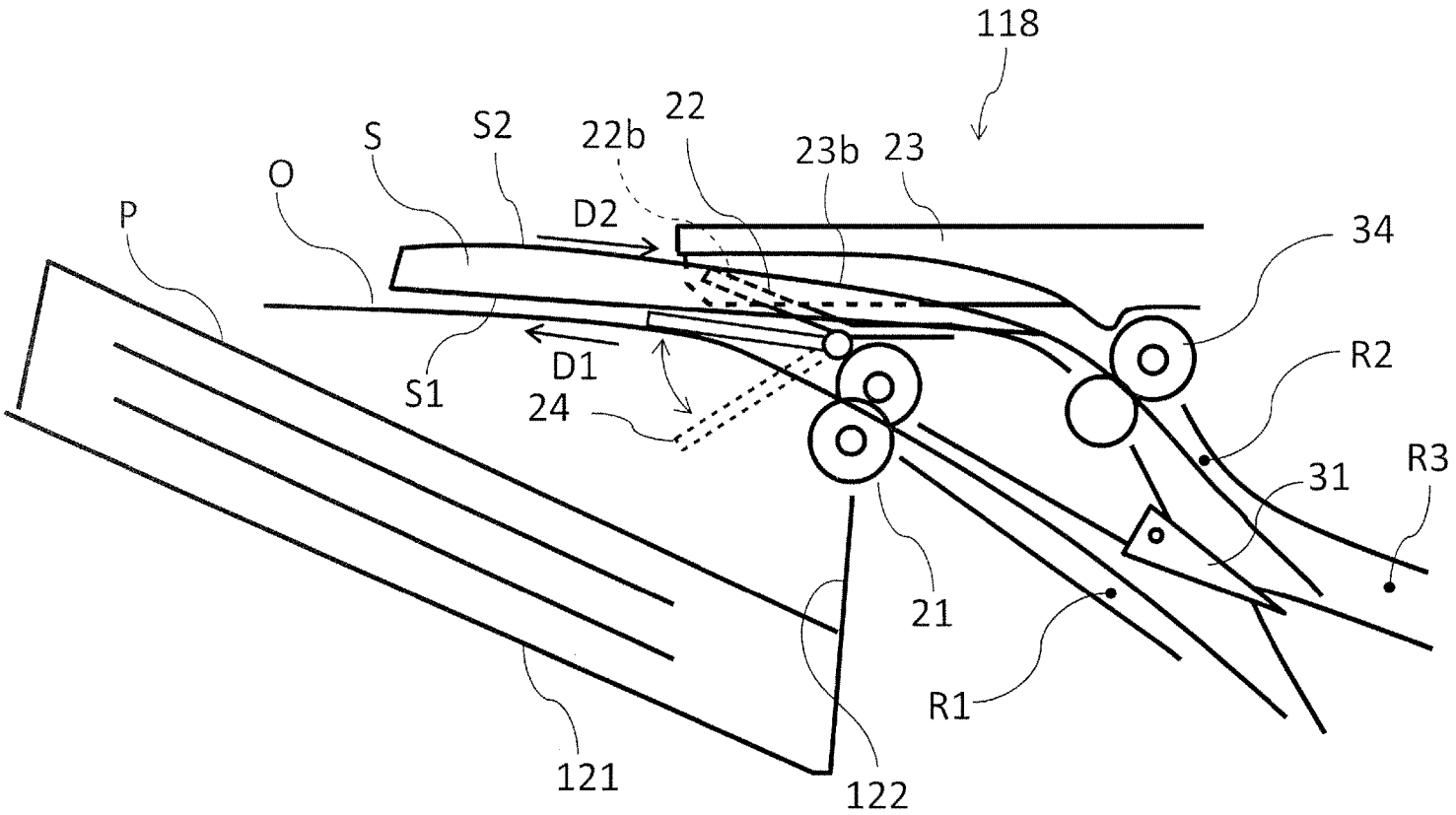
FIG. 5 is a cross-sectional view illustrating a full load detection flag during pass-by conveyance.

As illustrated in FIG. 5, during duplex printing, in a state where sheet O is discharged to the sheet discharge direction D1 by the sheet discharge roller pair 21, a pass-by conveyance is generally performed where the sheet S is drawn to the reverse direction D2 by the reverse conveyance roller pair 34. The sheet S conveyed by the reverse conveyance roller pair 34 is convexed upward by the reverse tray 22 and the top cover 23 so as to be stiffened, as described earlier, such that when viewed from the width direction, the convex of the sheet has a height in the vertical direction, as illustrated in FIG. 1. If both end portions in the width direction of the sheet S having stiffness imparted thereto are referred to as S1 and the center portion thereof is referred to as S2, both end portions S1 of the sheet S will be sagged downward without being supported by the center portion 22*b* of the reverse tray 22. Therefore, both end portions S1 of the sheet S may contact the sheet O discharged by the sheet discharge roller pair 21, and both sheet S and sheet O may be damaged.

Figure 6:
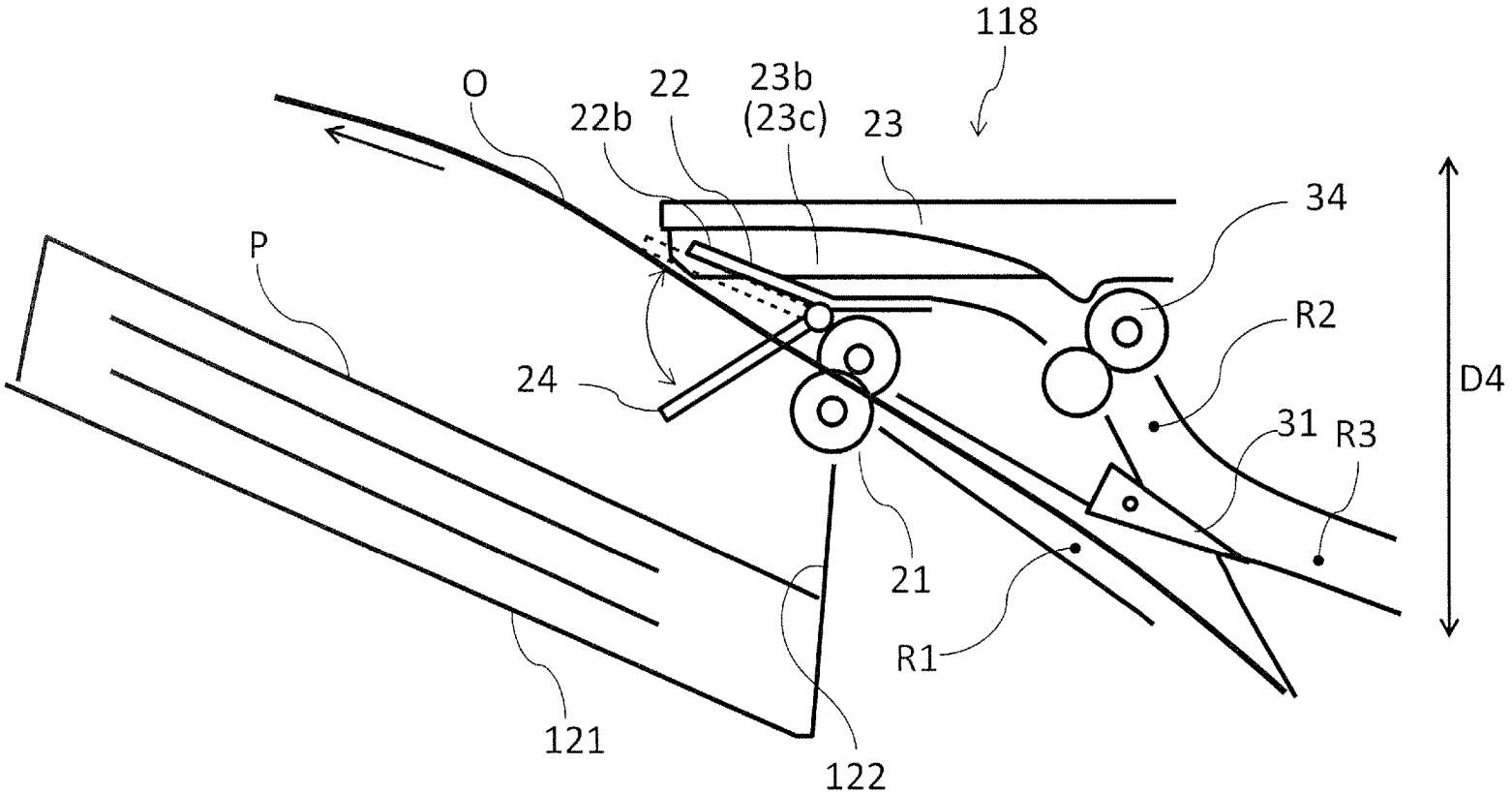
FIG. 6 is a cross-sectional view illustrating a full load detection flag positioned on an upper position.

However, according to the present embodiment, as illustrated in FIGS. 5 and 6, the full load detection flag 24 pivots upward by being pressed by the sheet S discharged by the sheet discharge roller pair 21, and during pass-by conveyance, the full load detection flag 24 is sandwiched between sheet S and sheet O. Specifically, since the upper surfaces 24*d* and 24*e* serving as supporting surfaces of the projected side portions 24*b* and 24*c* (refer to FIG. 3) of the full load detection flag 24 support both end portions S1 of the sheet S curved in an upward convexed manner, sheet S and sheet O are reliably prevented from being in contact with each other. Further, since the upper surfaces 24*d* and 24*e* of the projected side portions 24*b* and 24*c* can support both end portions S1, which is not being supported by the center portion 22*b* of the reverse tray 22, of the sheet S, the downward sagging of the sheet S can be reduced. Moreover, since the projected center portion 24*a* is arranged between the projected side portions 24*b* and 24*c* in the width direction, even if a sheet having a small width size is being discharged on the sheet discharge tray 121, the projected center portion 24*a* can abut against the sheet supported on the sheet discharge tray 121. Therefore, full-load of the sheet can be detected infallibly regardless of the sheet size.

The broken line of FIG. 6 illustrates an upper position where the full load detection flag 24 is pivoted to the uppermost position, and the full load detection flag 24 positioned at the upper position is arranged to be overlapped with the second conveyance ribs 23*b* and the third conveyance ribs 23*c* of the top cover 23 when viewed from the width direction. That is, the pivoting locus of the full load detection flag 24 serving as the pivot member is partially overlapped with the second conveyance ribs 23*b* and the third conveyance ribs 23*c* of the top cover 23 when viewed from the width direction. As illustrated in FIG. 3, the projected center portion 24*a* of the full load detection flag 24 is arranged between the second conveyance ribs 23*b* and the third conveyance ribs 23*c* in the width direction D3. Further, the projected side portions 24*b* and 24*c* are respectively arranged outward of the second conveyance ribs 23*b* and the third conveyance ribs 23*c* in the width direction D3. Therefore, even if the full load detection flag 24 is positioned at the upper position, the projected center portion 24*a* and the projected side portions 24*b* and 24*c* will not be in contact with the second conveyance ribs 23*b* and the third conveyance ribs 23*c* of the top cover 23. By forming the full load detection flag 24 and the top cover 23 in the above-described manner, the height of the printer 100 can be downsized.

Figure 7:
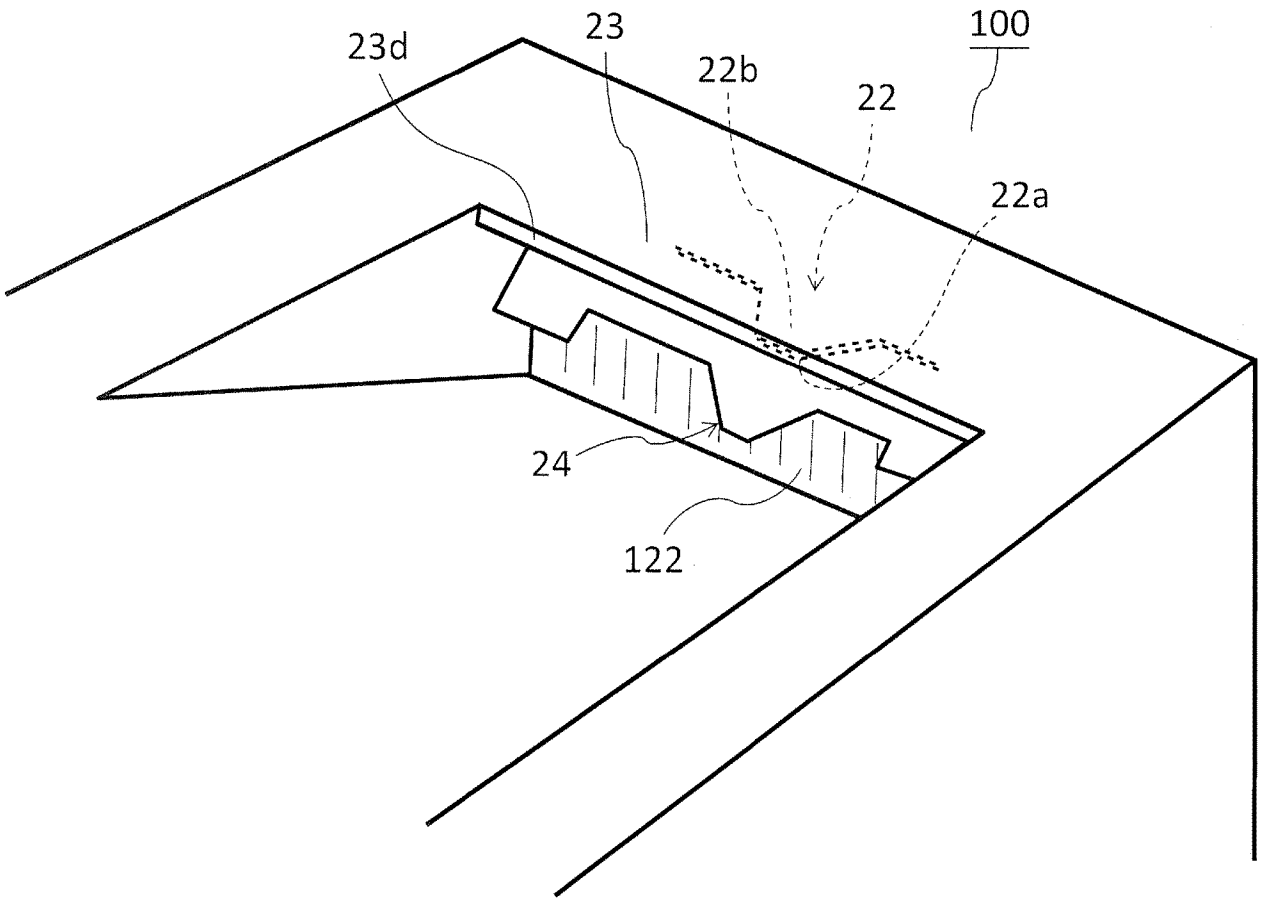
FIG. 7 is a perspective view illustrating an outer appearance of the printer.

Further, as illustrated in FIG. 7, since the top cover 23 serving as the opposing portion covers the upper portion of the reverse tray 22, the reverse tray 22 is configured to be hidden under the top cover 23 and not visible from the exterior. More specifically, a downstream end 23*d* of the top cover 23 in the sheet discharge direction D1 is arranged more downstream than a downstream end, that is, the tip portion 22*a*, of the reverse tray 22 in the sheet discharge direction D1.

This arrangement enables to prevent the user from accessing the reverse tray 22 and damaging the reverse tray 22, and thereby reduce jamming of the sheet. Further, even if water drops adhere to the reverse tray 22 by the vapor generated in the fixing unit 96, the water drops are not visible to the user, so that there is no need to provide additional components for hiding the water drops. Moreover, since the reverse tray 22 is not visible, the freedom of design of the whole apparatus can be improved. Since the length of the reverse tray 22 in the sheet discharge direction D1 is short, the reverse tray 22 will not be in the way when the user removes the sheet supported on the sheet discharge tray 121, and the usability is thereby improved.

Second Embodiment

Next, a second embodiment of the present invention will be described. A sheet discharge apparatus 188 according to the second embodiment is configured so that stiffness is imparted to the sheet by being convexed downward by a reverse tray and a top cover. The components similar to the first embodiment are either not shown in the drawing or denoted with the same reference numbers in the drawing.

Figure 8:
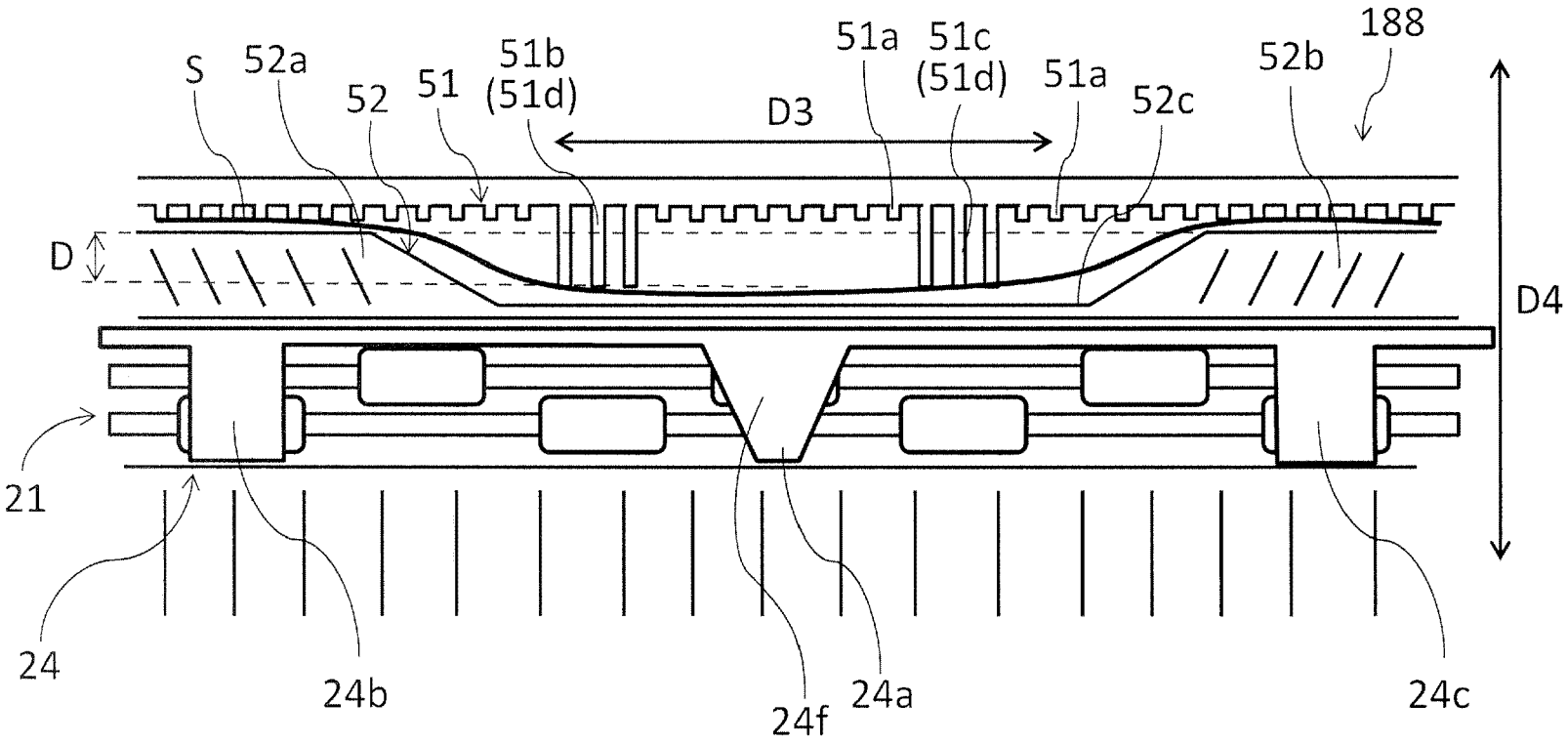
FIG. 8 is a view illustrating a sheet discharge apparatus according to a second embodiment.

As illustrated in FIG. 8, a reverse tray 52 serving as a supporting portion is arranged above the sheet discharge roller pair 21 and the full load detection flag 24, and a top cover 51 serving as an opposing portion is provided above the reverse tray 52. The top cover 51 is formed along the sheet discharge direction D1 and includes a plurality of first conveyance ribs 51*a* that extend downward toward the reverse tray 52 and second conveyance ribs 51*b* and 51*c* that extend further downward than the first conveyance rib 51*a*. According to the present embodiment, the second conveyance ribs 51*b* and 51*c* are arranged with a predetermined interval in the width direction, but the second conveyance ribs 51*b* and 51*c* can also be provided continuously in the width direction. The second conveyance ribs 51*b* and 51*c* serving as first and second protrusions constitute a first projected portions 51*d*.

The reverse tray 52 is configured to be inclined upward as it approaches the downstream side in the sheet discharge direction D1, and it includes a center portion 52*c* in the width direction formed to be recessed on the upstream side in the sheet discharge direction D1. That is, the reverse tray 52 includes a second projected portion 52*a* on one side of the center portion 52*c* in the width direction and a third projected portion 52*b* on the other side of the center portion 52*c* in the width direction. The second projected portion 52*a* and the third projected portion 52*b* are protruded upward toward the top cover 51.

The first projected portions 51*d* of the top cover 51 are arranged so that at least a part thereof is overlapped with the second and third conveyance ribs 23*b* and 23*c* between the second and third projected portions 52*a* and 52*b* in the width direction D3 when viewed from the width direction. That is, the first projected portions 51*d* of the top cover 51 are arranged so that at least a part thereof is overlapped with the second and third projected portions 52*a* and 52*b* in the sheet discharge direction D1 and the sheet thickness direction D4. Specifically, the first projected portions 51*d* are overlapped with the second projected portion 52*a* and the third projected portion 52*b* for distance D in the sheet thickness direction D4.

Figure 9:
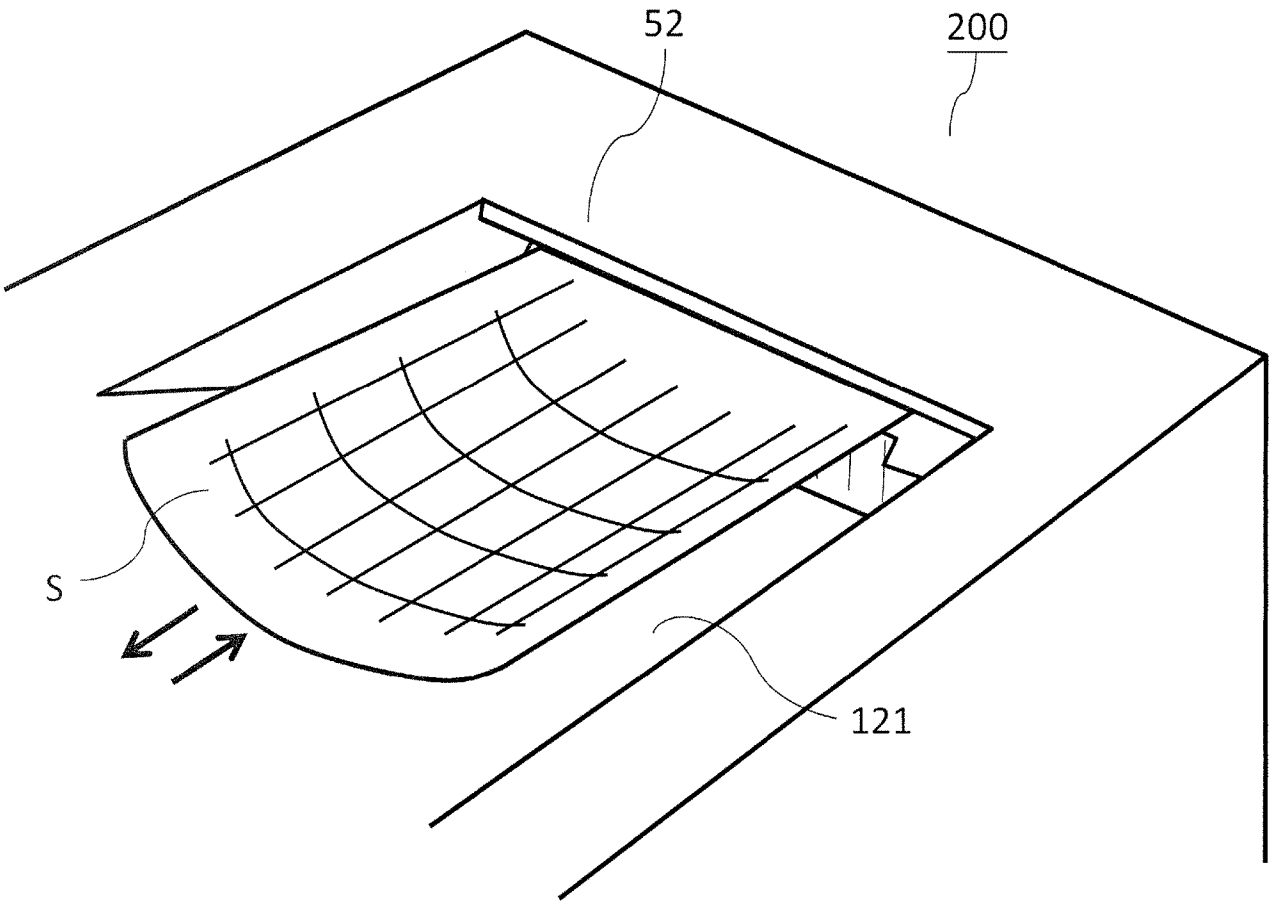
FIG. 9 is a perspective view illustrating a sheet having stiffness imparted by the sheet discharge apparatus.

Thanks to the first projected portions 51*d* of the top cover 51 and the second and third projected portions 52*a* and 52*b* of the reverse tray 52, stiffness is imparted to the sheet conveyed by the reverse conveyance roller pair 34 that deforms the sheet so that a center portion thereof is convexed downward, as illustrated in FIG. 9. Further, since the second and third projected portions 52*a* and 52*b* of the reverse tray 52 support the lower surface of the sheet S, the sagging of the sheet S can be prevented infallibly even in a state where a leading edge being the free end of the sheet S is suspended in air.

According further to the present embodiment, an upper surface 24*f* of the projected center portion 24*a* serving as a sixth projected portion of the full load detection flag 24 constitutes a supporting surface that is configured to support the lower surface of the sheet deformed in a downward convexed manner. Thereby, contact between the sheet discharged by the sheet discharge roller pair 21 and the sheet conveyed by the reverse conveyance roller pair 34 during pass-by conveyance can be prevented reliably. Further, the upper surface 24*f* of the projected center portion 24*a* is configured to support a center portion S2, that is not supported by the second projected portion 52*a* and the third projected portion 52*b* of the reverse tray 52, of the sheet S, such that the downward sagging of the sheet S is reduced.

Further, the projected center portion 24*a* and the projected side portions 24*b* and 24*c* of the full load detection flag 24 are respectively arranged at a position displaced in the width direction D3 with respect to the second conveyance ribs 51*b* and 51*c* of the top cover 51. Further, similar to the first embodiment, a part of the pivoting locus of the full load detection flag 24 is overlapped with the second conveyance ribs 51*b* and 51*c* of the top cover 23 when viewed from the width direction. Therefore, the height of the printer 200 can be downsized without the full load detection flag 24 and the top cover 51 being in contact with one another.

According to the first and second embodiments, a configuration has been illustrated where an upper area of the reverse tray 22 is covered by the top cover 23, but not all areas of the reverse tray 22 must be covered by the top cover 23. That is, a configuration can be adopted where a part of the reverse tray 22 is visible from the exterior. The top cover 23 is a component that constitutes the exterior surface of the printer 100, but it is not restricted thereto. For example, a configuration can be adopted where an image reading apparatus is connected above the top cover 23 so that the top cover 23 does not constitute the exterior surface.

According to the first and second embodiments, a single projected portion and two projected portions are respectively distributed to the reverse tray and the top cover, but the configuration is not restricted thereto. That is, the number of projected portions formed to the reverse tray and the top cover can be greater than one or two.

All the embodiments described earlier have been described regarding a printer 100 or 200 adopting an electrophotographic system, but the present invention is not restricted thereto. For example, the present invention can be applied to an ink jet-type image forming apparatus where images are formed to the sheet by ejecting ink from a nozzle.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-144926, filed Jul. 26, 2017, which is hereby incorporated by reference wherein in its entirety.

What is claimed is:

1. A sheet conveyance apparatus comprising:

a reverse conveyance portion configured to convey a sheet in a first conveyance direction and a second conveyance direction that is opposite to the first conveyance direction;

a supporting portion arranged downstream of the reverse conveyance portion in the first conveyance direction and configured to support a lower surface of the sheet conveyed by the reverse conveyance portion; and an opposing portion provided along and above the supporting portion and opposing to the supporting portion, wherein either one of the supporting portion and the opposing portion comprises a first projected portion that protrudes toward the other of the supporting portion and the opposing portion, the other of the supporting portion and the opposing portion comprises a second projected portion and a third projected portion that protrude toward the one of the supporting portion and the opposing portion, the first projected portion is arranged between the second projected portion and the third projected portion in a width direction intersecting with the first conveyance direction, and at least a part of the first projected portion is arranged to overlap with the second projected portion and the third projected portion in a sheet thickness direction intersecting with the first conveyance direction and the width direction.

2. The sheet conveyance apparatus according to claim 1, wherein the first projected portion is arranged to overlap with the second projected portion and the third projected portion in the first conveyance direction.

3. The sheet conveyance apparatus according to claim 1, wherein the opposing portion is arranged to cover an upper part of the supporting portion.

4. The sheet conveyance apparatus according to claim 1, wherein a downstream end of the opposing portion in the first conveyance direction is arranged more downstream in the first conveyance direction than a downstream end of the supporting portion in the first conveyance direction.

5. The sheet conveyance apparatus according to claim 1, further comprising:

a sheet discharge portion configured to convey the sheet in the first conveyance direction and discharge the sheet;

a sheet stacking portion arranged below the supporting portion and on which a sheet discharged by the sheet discharge portion is stacked; and a trailing edge regulating surface configured to regulate a position of a trailing edge of the sheet supported on the sheet stacking portion, wherein the supporting portion is formed to protrude more downstream than the trailing edge regulating surface in the first conveyance direction.

6. The sheet conveyance apparatus according to claim 5, further comprising:

a pivot member arranged below the supporting portion and configured to abut against the sheet supported on the sheet stacking portion and pivot; and a detection portion configured to detect full load of the sheet supported on the sheet stacking portion according to a position of the pivot member.

7. The sheet conveyance apparatus according to claim 6, wherein a part of a pivoting locus of the pivot member is overlapped with the opposing portion when viewed from the width direction.

8. The sheet conveyance apparatus according to claim 6, wherein the pivot member comprises a supporting surface configured to support a part, that is not supported by the supporting portion, of the sheet conveyed by the reverse conveyance portion.

9. The sheet conveyance apparatus according to claim 8, wherein the supporting portion comprises the first projected portion, the opposing portion comprises the second projected portion and the third projected portion that are arranged to interpose the first projected portion in the width direction, the pivot member comprises a fourth projected portion and a fifth projected portion that are arranged to interpose the first, second and third projected portions in the width direction, an upper surface of the fourth projected portion and an upper surface of the fifth projected portion constitute the supporting surface, and the supporting surface supports both end portions in the width direction of the sheet curved by the first, second and third projected portions.

10. The sheet conveyance apparatus according to claim 8, wherein the opposing portion comprises a first protrusion and a second protrusion arranged with a predetermined interval in the width direction and constituting the first projected portion, the supporting portion comprises the second projected portion and the third projected portion that are arranged to interpose the first and second protrusions in the width direction, the pivot member comprises a sixth projected portion arranged between the first and second protrusions in the width direction, an upper surface of the sixth projected portion constitutes the supporting surface, and the supporting surface supports a center portion of the sheet in the width direction curved by the first, second and third projected portions.

11. The sheet conveyance apparatus according to claim 1, wherein the reverse conveyance portion comprises a roller pair that forms a nip portion configured to nip and convey the sheet.

12. The sheet conveyance apparatus according to claim 11, further comprising an apparatus body configured to support the roller pair rotatably, wherein the supporting portion and the opposing portion are fixed members that are fixed to the apparatus body.

13. An image forming apparatus comprising:

an image forming unit configured to form an image on a sheet; and the sheet conveyance apparatus according to claim 1 configured to convey the sheet on which the image has been formed by the image forming unit.

* * * * *